US006135842A

United States Patent [19]

LaFata

[11] Patent Number: 6,135,842

[45] Date of Patent: Oct. 24, 2000

[54] SPILL-RESISTANT BUBBLE-BLOWING APPARATUS

[75] Inventor: John E. LaFata, Ventura, Calif.

[73] Assignees: Oddzon, Inc., Pawtucket, R.I.; TOI, LLC, Ventura, Calif.

[21] Appl. No.: 09/290,588

[22] Filed: Apr. 13, 1999

Related U.S. Application Data

[63] Continuation of application No. 09/229,256, Jan. 12, 1999.

[51] Int. Cl.[7] ..... A63H 33/28; B65D 81/24

[52] U.S. Cl. ..... 446/15; 446/16; 206/209; 206/207; 206/223; 221/63

[58] Field of Search ..... 446/15, 16; 221/63; 220/736, 729, 90.2; 206/209

[56] References Cited

U.S. PATENT DOCUMENTS

| | | | |
|---|---|---|---|
| Re. 36,131 | 3/1999 | Schramm | 141/98 |
| D. 359,294 | 6/1995 | Szabo | D15/199 |
| D. 359,295 | 6/1995 | Szabo | D15/199 |
| 2,436,291 | 2/1948 | Daniel . | |
| 2,858,639 | 11/1958 | Lawrence | 46/7 |
| 3,109,255 | 11/1963 | Hein | 446/15 |
| 3,520,077 | 7/1970 | Bockhacker | 446/15 |
| 3,579,898 | 5/1971 | Hein | 446/15 |
| 3,583,018 | 6/1971 | Fink . | |
| 3,696,958 | 10/1972 | Lee | 215/56 |
| 3,736,694 | 6/1973 | Lebensfeld | 446/15 |
| 3,818,627 | 6/1974 | Lebensfeld | 446/15 |
| 3,958,362 | 5/1976 | Kessler | 446/15 |
| 3,986,479 | 10/1976 | Bonk | 221/63 |
| 3,994,417 | 11/1976 | Boedecker | 221/63 |
| 4,180,938 | 1/1980 | La Fata | 446/15 |
| 4,244,478 | 1/1981 | Handman | 215/249 |
| 4,534,491 | 8/1985 | Norton | 221/63 |
| 4,981,239 | 1/1991 | Cappel et al. | 222/109 |
| 4,984,714 | 1/1991 | Sledge | 222/109 |
| 5,025,947 | 6/1991 | Leone | 220/90.2 |
| 5,143,236 | 9/1992 | Gueret | 215/311 |
| 5,169,026 | 12/1992 | Patterson | 220/740 |
| 5,304,085 | 4/1994 | Novak | 446/16 |
| 5,467,893 | 11/1995 | Landis | 221/34 |
| 5,718,353 | 2/1998 | Kanfer | 221/63 |
| 5,909,138 | 6/1999 | Vlahakis | 221/63 |
| 5,927,488 | 7/1999 | Gray | 221/63 |
| 6,030,582 | 2/2000 | Levy | 422/99 |
| 6,041,919 | 3/2000 | Adams | 206/15.3 |

*Primary Examiner*—Kien T. Nguyen
*Assistant Examiner*—Kevin Hughes
*Attorney, Agent, or Firm*—Marshall, O'Toole, Gerstein, Murray & Borun

[57] ABSTRACT

A spill-resistant bubble-blowing apparatus, adapted to be used with a bottle filled with bubble solution and a bubble-blowing wand disposed in the bottle and being sized to allow the bubble-blowing wand to pass through the opening in the bottle, is provided with a cap portion adapted to be coupled to a bubble-solution bottle and having an opening formed therein and an insert adapted to be disposed adjacent the cap portion. The insert has a raised portion with a perimeter that corresponds to the opening in the cap portion and a central portion with a slot formed therein, with the central portion of the insert being composed of a flexible material. The slot in the central portion is sized to allow a bubble-blowing end of a bubble-blowing wand to pass through it and has a width small enough to prevent significant passage of bubble solution through the cap portion. The central portion of the insert may be provided with one or more pairs of opposed flexible flaps which are separated from each other by the slot in the insert.

10 Claims, 2 Drawing Sheets

SPILL-RESISTANT BUBBLE-BLOWING APPARATUS

This is a continuation of U.S. Ser. No. 09/229,256 filed Jan. 12, 1999 and entitled "Spill-Resistant Bubble-Blowing Apparatus."

BACKGROUND OF THE INVENTION

The present invention is directed to a spill-resistant bubble-blowing apparatus having a container cap designed to prevent spillage from a container filled with bubble solution.

U.S. Pat. No. 4,180,938 to LaFata, et al. discloses a jar 40 for holding bubble solution and a cap 42 which may be placed over the top of the jar 40. As shown in FIG. 8 of the patent, the cap 42 may be held onto the jar 40 via a lip 44 formed on the side of the jar 40 which mates with a flanged ridge 46 disposed on an interior periphery of the cap 42. As shown in FIGS. 9–11 of the LaFata, et al. patent, the cap 42 may have one or more slits 50 formed therein. The purpose of the slits 50 is to allow a bubble-blowing wand to be inserted into the jar 40 through the cap 42 and removed from the jar 40 while at the same time preventing significant spillage of bubble solution from the jar 40, as described at column 5, lines 22–44 of the LaFata, et al. patent.

A prior art product referred to as a "Bubble Funset" includes a package which contains a cylindrically shaped bottle filled with bubble solution, a hexahedral-shaped container (designated 10 in FIG. 1A) for holding bubble solution, a bubble-blowing wand (designated 30 in FIG. 1C), a suction cup adapted to be attached to the container 10, and a tube. The cylindrically shaped bottle (not shown) has a threaded circular mouth at its upper end, a circular seal adhesively connected to the top of the mouth of the bottle to prevent leakage of the bubble solution, and a plastic cap threaded onto the bottle over the seal. The seal is composed of a paper layer adhered to a foil layer, with the foil layer facing downwards and being in contact with the bubble solution in the bottle.

The hexahedral-shaped container 10, which is marked with the patent number of the LaFata patent described above, is shown in FIGS. 1A and 1B of this patent. Referring to FIGS. 1A and lB, the container 10 is composed of a hexahedral-shaped plastic cup 12 having a rectangular cross section, as shown in FIG. 1B, and a flexible, elastomeric spill-proof cap 14 that is adapted to be snap-fit into a top portion 16 of the cup 12.

As shown in FIG. 1B, which is a top view of the container 10, the spill-proof cap 14 has a first elongate slit 18 and three relatively short transverse slits 20 formed therein. The slits 18, 20 are formed so as to allow the bubble-blowing wand 30 (FIG. 1C) of the prior art product to be inserted through the slit 18 in the cap 14 into the cup 12 and removed from the cup 12 through the slit 18. The cup 12 has a downwardly extending arm 22 (only the top horizontal portion of the arm is shown) to which the suction cup (not shown) can be attached to allow the cup 12 to be attached by the suction cup to a surface, such as bathtub wall tile.

The instructions on the reverse side of the packaging of the prior art product instruct the user to take the following steps, among others, in using the product: 1) pour the bubble solution from the cylindrical bottle (not shown) into the cup 12 and snap in the spill-proof cap 14; 2) insert the wand 30 through the cap 14 and into the bubble solution in the cup 12; and 3) pull the wand 30 out of the cup 12 and blow bubbles with the wand 30.

The bubble-blowing wand 30 of the prior art product is shown in FIG. 1C. Referring to FIG. 1C, the wand 30 is composed of plastic and has a handle portion 32, a bubble-blowing end 34, a stem portion 36, and a rectangular sealing member 38. The outer periphery of the sealing member 38 is shaped to correspond to the interior rectangular cross section of the top portion 16 of the cup 12, and the sealing member 38 fits within a groove or slot (not shown) formed in the interior of the top portion 16. The prior art product was apparently designed so that when the wand 30 is placed through the slot 18 and snap-fit, over the spill-proof cap 14, into the top portion 16 of the cup 12, the sealing member 38 would prevent bubble solution from spilling from the cup 12. The wand 30 was not designed to fit entirely within the cup 12, and it is too long to fit entirely within the cup 12.

SUMMARY OF THE INVENTION

The invention is directed to a spill-resistant apparatus adapted to be used with a bubble-blowing apparatus having a bottle filled with bubble solution and a bubble-blowing wand disposed in the bottle and being sized to allow the bubble-blowing wand to pass through the opening in the bottle. The spill-resistant apparatus includes a cap portion adapted to be coupled to the bottle and an insert adapted to be disposed adjacent the cap portion. The insert has a raised portion with a perimeter that corresponds to an opening formed in the cap portion and a central portion with a slot formed therein, with the central portion of the insert being composed of a flexible material. The slot in the central portion of the insert is sized to allow a bubble-blowing end of the wand to pass through it and has a width small enough to prevent significant passage of bubble solution through the cap portion. The central portion of the insert may be provided with one or more pairs of opposed flexible flaps which are separated from each other by the slot in the insert.

The apparatus may also include a bottle filled with bubble solution, a bubble-blowing wand disposed in the bottle and being sized to allow the wand to pass through an opening in the bottle, a seal disposed against the opening in the bottle while the wand is disposed entirely within the bottle, and a cap disposed on the bottle.

The features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1A:
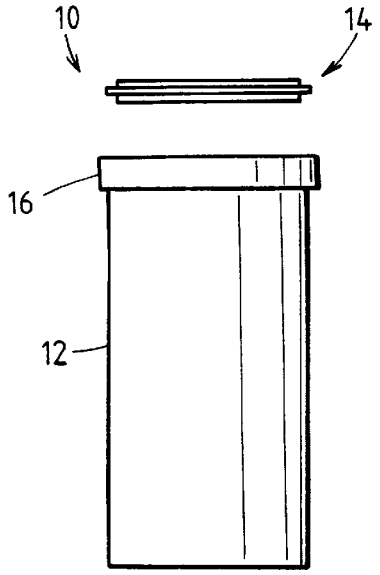
FIG. 1A PRIOR ART
FIG. 1A is an exploded side view of a prior art container included with a prior art product.
Figure 1B:
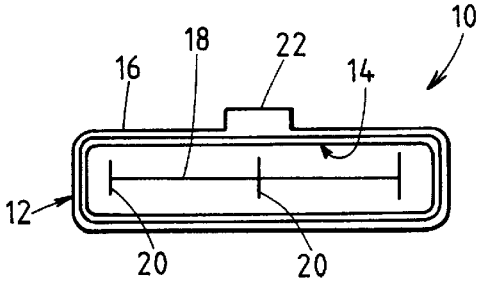
FIG. 1B PRIOR ART
FIG. 1B is a side view of the prior art container of FIG. 1A.
Figure 1C:
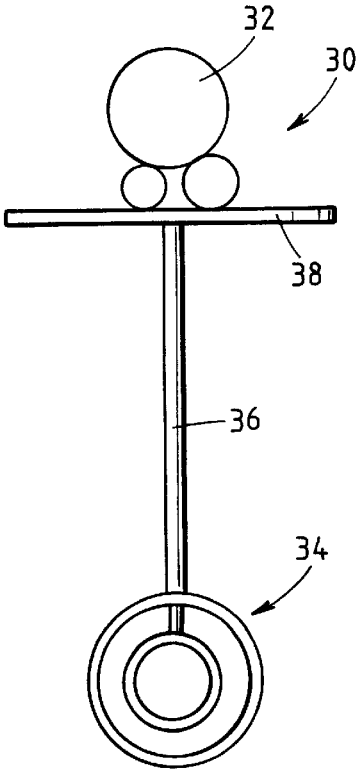
FIG. 1C PRIOR ART
FIG. 1C is a view of a bubble-blowing wand included with the prior art product.
Figure 2A:
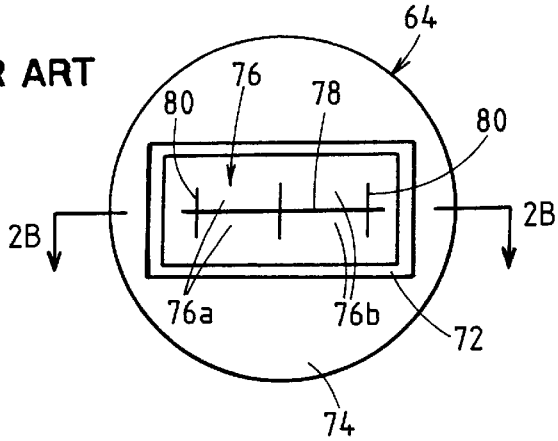
FIG. 2A is a top view of a preferred embodiment of an insert in accordance with the invention.
Figure 2B:
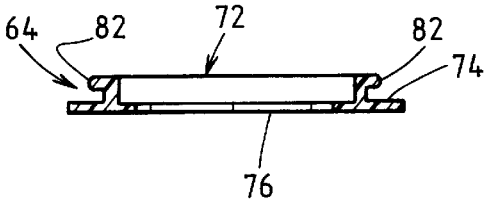
FIG. 2B is a cross-sectional side view of the insert of FIG. 2A taken along the lines 2B—2B shown in FIG. 2A.
Figure 3:
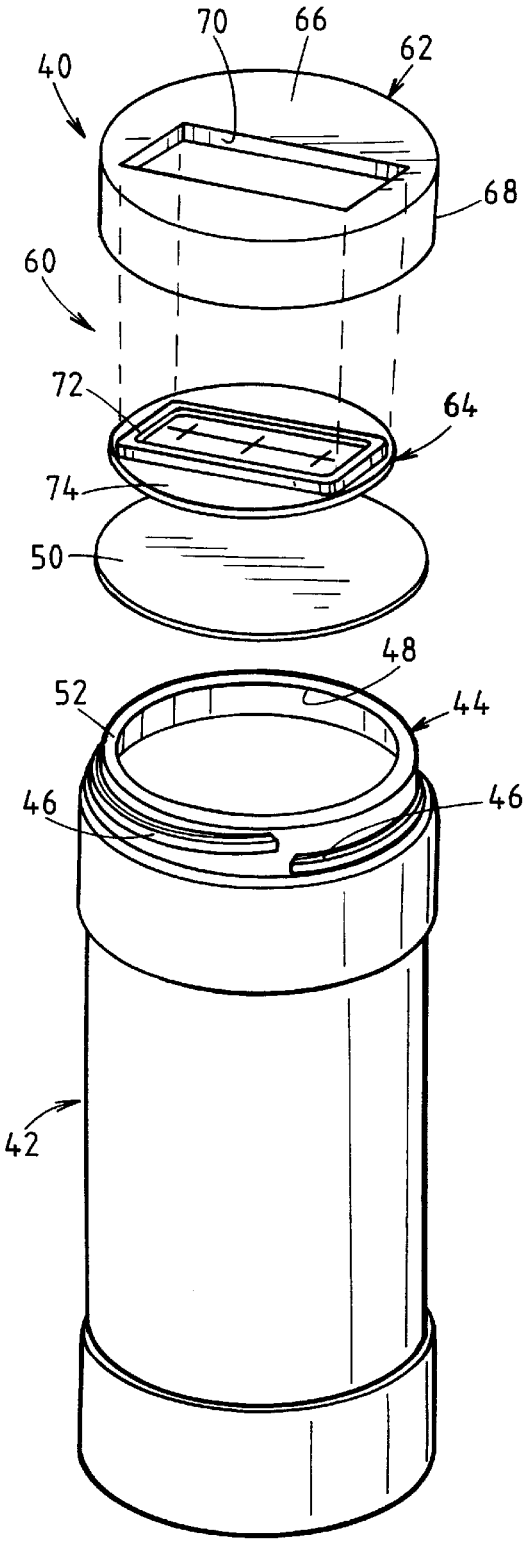
FIG. 3 is an exploded perspective view a preferred embodiment of a bubble-blowing apparatus in accordance with the invention.
Figure 4:
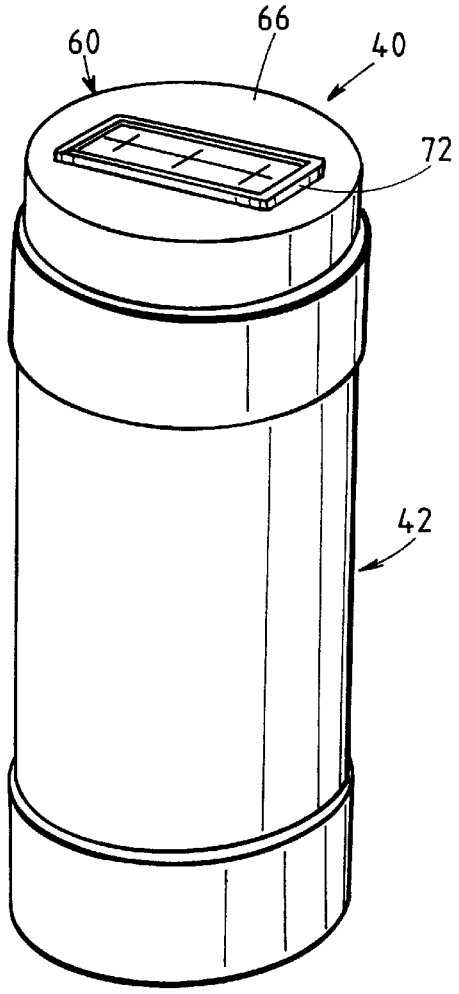
FIG. 4 is a perspective view of the bubble-blowing apparatus of FIG. 3 in assembled form.

A preferred embodiment of a spill-resistant bubble-blowing apparatus 40 is shown in FIGS. 2A–5. Referring to FIGS. 3 and 4, the apparatus 40 has a bottle 42 filled with bubble solution. The bottle 42 has a neck portion 44 which has one or more threads 46 disposed thereon and a circular opening 48. A seal 50 is disposed adjacent the opening 48 to seal the opening 48 and prevent bubble solution from leaking from the bottle 42 through the opening 48.

The seal 50 may be composed of foil or other material through which the bubble solution does not readily pass, with the seal 50 being adhesively connected to an annular lip 52 surrounding the opening 48.

Referring to FIG. 3, the apparatus 40 includes a cap 60 composed of a cap portion 62 and an insert 64. The cap portion 62 has a flat portion with an upper surface 66, a vertically disposed, annular periphery 68 that extends downwardly from the upper surface 66 and which is generally perpendicular to the upper surface 66, and a rectangular opening 70 formed in the upper surface 66.

The insert 64, which is circular in shape, is adapted to be press fit within the cap portion 62 so that the insert 64 lies adjacent the cap portion 62 just below the cap portion 62. The insert 64 has a rectangular portion or rib 72 that is raised relative to an outer upper surface 74 of the insert 64. The insert 64 has a central portion 76 which is disposed within the rectangular rib 72 and which has a main slot 78 and three transverse slots 80 formed therein so as to define a first pair of flexible flaps 76*a* and a second pair of flexible flaps 76*b*, as shown in FIG. 2A.

As shown in FIG. 2B, the rectangular rib 72 of the insert 64 may be provided with a horizontally extending portion or lip 82 to facilitate the retention of the insert 64 within the cap portion 62. The insert 64 is composed of a flexible material, such as rubber or plastic, and the outer perimeter of the lip 82 is slightly larger than the opening 70 formed in the cap portion 62, so that the lip 82 is somewhat compressed as it passes through the opening 70 in the cap portion 62 when the insert 64 is forced against the underside of the cap portion 62. After passing through the opening 70, the lip 82 reverts to its original shape, as shown in FIG. 2B, to retain the insert 64 against the underside of the cap portion 62. The press- or interference-fit of the insert 64 against the cap portion 62 could be accomplished in other ways by making those components 62, 64 with suitable dimensions.

Figure 5:
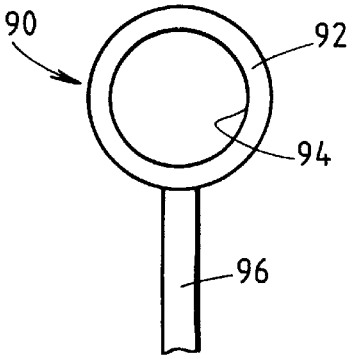
FIG. 5 is a view of a bubble-blowing wand.

As shown in FIG. 5, the apparatus 40 also includes a bubble-blowing wand 90 which is sized to be disposed entirely within the interior of the bottle 42, along with the bubble solution. The wand 90, which is only partially shown in FIG. 5, has a bubble-blowing end, which may be in the form of a circular member 92 in which a circular hole 94 is formed, that is attached to a stem portion 96. The outer diameter of the circular member 92 is smaller than the diameter of opening 48 (FIG. 3) in the bottle 42 so that the entire wand 90 fits within the bottle 42. The outer diameter of the circular member 92 is also smaller than the length of the elongate slot 78 in the insert 64 (FIG. 2A) so that the bubble-blowing end 92 of the wand 90 may be readily passed through the slot 78.

In use, the bubble-blowing apparatus 40 is opened by unscrewing the cap 60 (since the insert 64 is press fit into the cap portion 62, these two components 62, 64 come off together) from the bottle 42 and by removing the seal 50 from the circular lip 52 of the bottle 42. After the seal 50 is removed, the wand 90 is removed from the bubble solution in the bottle 42, and the cap 60 is then threaded back onto the bottle 42 tightly.

The bubble-blowing apparatus 40 may then be used by forcing the bubble-forming end 92 of the wand 90 through the slot 78 in the cap 60 (and spreading the elastically flexible flaps 76*a*, 76*b* slightly apart to accommodate the width or thickness of the bubble-forming end 92) and into the bubble solution in the bottle 42, removing the wand 90 from the bottle 42 (after which the flaps 76*a*, 76*b* resume their substantially closed position as shown in FIG. 2A), and then forming bubbles from the bubble solution that covers the bubble-forming end 92 of the wand 90.

If the bottle 42 should accidently be knocked over during use of the apparatus 40, the relatively small width (preferably less than one-sixteenth of an inch in width) of the slits 78, 80 in the cap 60 will prevent any significant spillage of the bubble solution from the bottle 42.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A bubble-blowing apparatus, comprising:

a bottle which contains bubble solution suitable for forming bubbles, said bottle having an opening and a lip portion;

a bubble-blowing wand disposed in said bottle, said bubble-blowing wand being sized to allow said bubble-blowing wand to pass through said opening in said bottle and to be disposed entirely within said bottle, said bubble-blowing wand having a bubble-blowing end; and a cap disposed on said bottle, said cap comprising:

a cap portion having an opening formed therein, said opening having a maximum dimension; and an insert disposed adjacent said cap portion, said insert having an outer portion with an outer dimension and a raised portion which extends through and contacts said cap opening, said outer dimension of said outer portion being greater in size than said maximum dimension of said opening in said cap portion so that said insert cannot pass through said opening in said cap portion regardless of the orientation of said insert relative to said cap portion, said insert having a central portion with a slot formed therein, said central portion of said insert being composed of a flexible material and said slot being sized to allow said bubble-blowing end of said bubble-blowing wand to pass through said slot, said slot having a width small enough to prevent significant spillage of bubble solution from said bottle when said cap is disposed on said bottle, said outer portion of said insert being sandwiched between said lip portion of said bottle and said cap portion when said cap portion is disposed on said bottle to prevent said insert from being removed from said bubble-blowing apparatus when said cap portion is disposed on said bottle.

2. An apparatus as defined in claim 1 wherein said cap portion has an upper surface and an outer periphery, wherein said outer periphery of said cap portion extends downwardly from said upper surface of said cap portion, wherein said outer periphery of said cap portion and said upper surface of said cap portion are disposed approximately at right angles to each other, and wherein said insert is disposed within said cap portion.

3. An apparatus as defined in claim 1 additionally comprising a seal adhesively sealed to close said opening in said bottle.

4. An apparatus as defined in claim 1 wherein said opening in said bottle comprises a circular opening.

5. An apparatus as defined in claim 1 wherein said central portion of said insert has a pair of opposed flexible flaps which are separated from each other by said slot.

6. An apparatus as defined in claim 1 wherein said central portion of said insert has two pairs of opposed flexible flaps which are separated from each other by said slot.

7. A bubble-blowing apparatus, comprising:

a bottle which contains bubble solution suitable for forming bubbles, said bottle having an opening and a circular lip portion;

a bubble-blowing wand disposed in said bottle, said bubble-blowing wand being sized to allow said bubble-blowing wand to pass through said opening in said bottle and to be disposed entirely within said bottle, said bubble-blowing wand having a bubble-blowing end; and a cap disposed on said bottle, said cap comprising a cap portion having an opening formed therein and an insert disposed adjacent said cap portion, said cap having a central portion with a slot formed therein, said central portion of said cap being composed of a flexible material and said slot being sized to allow said bubble-blowing end of said bubble-blowing wand to pass through said slot, said slot having a width small enough to prevent significant spillage of bubble solution from said bottle when said cap is disposed on said bottle said insert having an outer portion that is sandwiched between said lip portion of said bottle and said cap portion when said cap portion is disposed on said bottle to prevent said insert from being removed from said bubble-blowing apparatus when said cap portion is disposed on said bottle, wherein said opening in said cap portion has a shape and wherein said insert has a raised portion with a shape that is substantially the same as said shape of said opening in said cap portion.

8. An apparatus as defined in claim 7 wherein said cap portion has an upper surface and an outer periphery, wherein said outer periphery of said cap portion extends downwardly from said upper surface of said cap portion, wherein said outer periphery of said cap portion and said upper surface of said cap portion are disposed approximately at right angles to each other, and wherein said insert is disposed within said cap portion.

9. An apparatus as defined in claim 7 wherein said central portion of said insert has a pair of opposed flexible flaps which are separated from each other by said slot.

10. An apparatus as defined in claim 7 wherein said central portion of said insert has two pairs of opposed flexible flaps which are separated from each other by said slot.

* * * * *

UNITED STATES PATENT AND TRADEMARK OFFICE

CERTIFICATE OF CORRECTION

PATENT NO. : 6,135,842
DATED : October 24, 2000
INVENTOR(S) : Steven Menow et al.

It is certified that error appears in the above-identified patent and that said Letters Patent is hereby corrected as shown below:

Title page,
Item [75], Inventors, add -- Steven Menow, Fairfield, CA; -- immediately preceding "John E. LaFata.".

Signed and Sealed this

Eighth Day of November, 2005

JON W. DUDAS
*Director of the United States Patent and Trademark Office*